US008280274B2

(12) United States Patent
Jung et al.

(10) Patent No.: US 8,280,274 B2
(45) Date of Patent: Oct. 2, 2012

(54) ROLLER, DEVELOPING UNIT AND IMAGE FORMING APPARATUS HAVING THE SAME, AND METHOD OF MANUFACTURING ROLLER

(75) Inventors: Hee-Won Jung, Suwon-Si (KR); Ki-Jae Do, Suwon-Si (KR); Tae-Hyun Kim, Hwaseong-Si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 555 days.

(21) Appl. No.: 12/469,919

(22) Filed: May 21, 2009

(65) Prior Publication Data

US 2010/0054821 A1 Mar. 4, 2010

(30) Foreign Application Priority Data

Aug. 27, 2008 (KR) ..... 10-2008-0084146

(51) Int. Cl.
*G03G 15/02* (2006.01)
*G03G 21/00* (2006.01)

(52) U.S. Cl. ..... 399/100; 399/353; 399/357

(58) Field of Classification Search ..... 399/100, 399/101, 272, 281, 286, 287, 353, 357; 492/49, 492/52, 53, 56, 57, 59; 156/60, 154, 242, 156/244.24
See application file for complete search history.

(56) References Cited

U.S. PATENT DOCUMENTS

| | | | | |
|---|---|---|---|---|
| 4,756,065 | A * | 7/1988 | Carlson | 492/56 |
| 4,990,963 | A * | 2/1991 | Yamamoto et al. | 399/286 |
| 6,149,564 | A * | 11/2000 | Nozawa et al. | 399/281 X |
| 6,161,673 | A * | 12/2000 | Nimmo et al. | 193/37 |
| 2002/0085863 | A1 | 7/2002 | Nakamura et al. | |
| 2002/0142134 | A1 | 10/2002 | Masuda et al. | |
| 2006/0056881 | A1 | 3/2006 | Kim | |
| 2006/0115292 | A1 * | 6/2006 | Sampe et al. | 399/100 |
| 2007/0111874 | A1 | 5/2007 | Sugimura et al. | |
| 2007/0197362 | A1 * | 8/2007 | Sakata et al. | 492/49 |
| 2007/0286635 | A1 * | 12/2007 | Matsui et al. | 399/100 |

FOREIGN PATENT DOCUMENTS

| | | |
|---|---|---|
| EP | 0 798 343 | 10/1997 |
| JP | 57-061574 | 4/1982 |
| JP | 62-021662 | 1/1987 |
| JP | 2003-015454 | 1/2003 |
| JP | 2006-184602 | 7/2006 |
| JP | 2008-020634 | 1/2008 |

OTHER PUBLICATIONS

European Search Report issued in EP 091550269.9, mailed Dec. 9, 2009.

(Continued)

*Primary Examiner* — Sandra Brase
(74) *Attorney, Agent, or Firm* — Stanzione & Kim, LLP

(57) ABSTRACT

A roller for use in a developing unit of an image forming apparatus may include a non-conductive shaft member and a non-conductive member to surround at least a part of an outer periphery of the shaft member. The shaft member may include a cylindrical rolling part and a pair of support parts formed to project from both ends of the rolling part in a lengthwise direction. The rolling part of the shaft member may be arranged opposite a charge roller in a developing unit and may rotate in contact with the charge roller to absorb and remove foreign substances adhered to a surface of the charge roller.

16 Claims, 4 Drawing Sheets

OTHER PUBLICATIONS

English language abstract of JP 62-021662, published Jan. 30, 1987.
English language abstract of JP 57-061574, published Apr. 14, 1982.
English language abstract of JP 2003-015454, published Jan. 7, 2003.
Machine English language translation of JP 2003-015454, published Jan. 17, 2003.
English language abstract of JP 2006-184602, published Jul. 13, 2006.
Machine English language translation of JP 2006-184602, published Jul. 13, 2006.
English language abstract of JP 2008-020634, published Jan. 31, 2008.
Machine English language translation of JP 2008-020634, published Jan. 31, 2008.

* cited by examiner

ROLLER, DEVELOPING UNIT AND IMAGE FORMING APPARATUS HAVING THE SAME, AND METHOD OF MANUFACTURING ROLLER

CROSS-REFERENCE TO RELATED APPLICATIONS

This application claims the benefit under 35 U.S.C. §119 of Korean Patent Application No. 10-2008-0084146, filed on Aug. 27, 2008, in the Korean Intellectual Property Office, the entire disclosure of which is incorporated herein by reference.

TECHNICAL FIELD

The present disclosure relates to a roller provided in an image forming apparatus and including a non-conductive shaft member and a non-conductive member surrounding the shaft member. The present disclosure further relates to a developing unit and an image forming apparatus including the roller, as well as to a method of manufacturing the roller.

BACKGROUND

Generally, an image forming apparatus, such as a laser printer, a copy machine, a facsimile, and the like, performs a printing operation by forming an electrostatic latent image on an image carrier, developing the latent image into a toner image by supplying toner to the latent image, and transferring the toner image onto a printing medium.

In order to form the latent image on the image carrier, a surface of the image carrier is typically charged to a predetermined voltage. An image forming apparatus may include a charge roller to charge the surface of the image carrier.

Foreign substances, such as toner, shredded paper, dust, and the like, may adhere to the surface of a charge roller. The adherence of foreign substances to the surface of the charge roller may cause the conduction characteristic of the charge roller to deteriorate, or the resistance of the charge roller may be heightened, resulting in a deterioration of the picture quality.

Accordingly, several methods for removing foreign substances adhering to the surface of a charge roller have been introduced. Examples of representative methods include a method of electrically removing foreign substances by using a difference in voltage or polarity between a charge roller and an elastic material, such as rubber, that is in contact with the charge roller; a method of raking up foreign substances by making a film made of a material, such as urethane, in contact with the surface of the charge roller; and a method of adsorbing foreign substances adhering to the charge roller through a cleaning roller having elastic foam.

The method of electrically removing the foreign substances has a relatively advantageous effect, with the drawback that a separate electric mechanism is required. The method of raking up the foreign substances has a drawback in which a separate space to store the foreign substances removed from the charge roller is required. Thus, an improved apparatus that removes or eliminates the adherence of foreign substances to the surface of a charge roller is desired.

SUMMARY

A roller for use in a developing unit of an image forming apparatus may include a non-conductive shaft member and a non-conductive member surrounding at least a part of an outer periphery of the shaft member.

The shaft member may be formed of a plastic material. The shaft member may be formed by injection molding or extrusion molding. Glass fiber or polystyrene may be added to the shaft member. A section of the shaft member may be in any one of circular, hollow circular, "H", "I", "T", and "Z" shapes. The non-conductive member may be formed of an elastic material having a porous structure. The non-conductive member may be formed of polyurethane foam. The non-conductive member may be formed of a rubber material.

The shaft member may include a non-conductive rolling part, of which at least a part is surrounded by the non-conductive member, and a pair of support parts provided at both ends of the rolling part in a shaft direction to support the rolling part. The rolling part and the support parts may be made of the same material. The rolling part may be formed of a plastic material, and the support parts may be formed of a metallic material. The shaft member may be formed by insert molding. The roller may remove foreign substances on a surface of a charge roller to charge an image carrier of the image forming apparatus. The non-conductive member may be provided with a plurality of hairs planted on an outer periphery of the shaft member. The resistance of the shaft member and the non-conductive member may be more than $10^9\Omega$.

According to another aspect, a developing unit of an image forming apparatus may include an image carrier; a charge roller to charge a surface of the image carrier; a cleaning roller to remove foreign substances on a surface of the charge roller; a developing roller to deliver a developer to the surface of the image carrier; a supply roller to supply the developer to the developing roller; and a transfer roller to transfer an image formed on the image carrier to a print medium. At least one of the rollers included in the developing unit may include a non-conductive shaft member and a non-conductive member to surround at least a part of an outer periphery of the shaft member.

The shaft member may be formed of a plastic material. The non-conductive member may be formed of an elastic material having a porous structure. The non-conductive member may be formed of polyurethane foam.

According to still another aspect, an image forming apparatus may include the above-described developing unit.

According to still another aspect, a method of manufacturing a roller may include (a) forming a non-conductive shaft member and a non-conductive member; (b) adhering the non-conductive member to the shaft member; and (c) processing an outer periphery of the non-conductive member with desired measurements.

If the shaft member of the roller provided in the image forming apparatus is made of a plastic material, the manufacturing cost of the roller is lowered and the manufacturing process of the roller is simplified.

In addition, in the case where the roller is a cleaning roller to remove the foreign substances on the surface of the charge roller of the image forming apparatus, the cleaning roller may be manufactured to have the non-conductivity on the whole, and thus the cleaning performance by a frictional force (or friction charging force) may be improved. Also, the shaft member of the cleaning roller may be formed of a non-metallic material, such as plastic, and thus the abrasion of a rubber layer of the charge roller may be relieved.

In addition, the shaft member of the rollers adjacent to or in contact with the image carrier, such as the charge roller, the cleaning roller, and the developing roller, may be formed of a non-metallic material, such as plastic that is relatively light, and thus damage of the surface of the image carrier which may occur due to an external impact, or an outflow of waste toner from a waste toner space, may be prevented.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
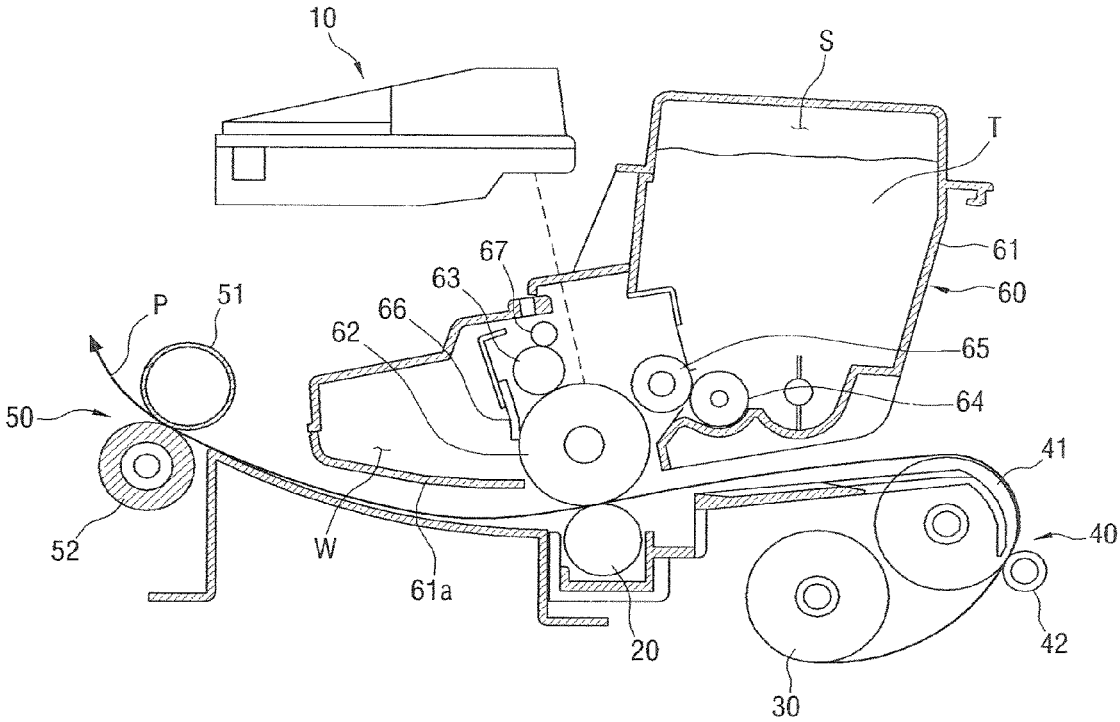
FIG. 1 is a schematic view illustrating an image forming apparatus according to an embodiment.

Reference will now be made in detail to embodiments of the present invention, examples of which are illustrated in the accompanying drawings, wherein like reference numerals refer to like elements. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

With reference to FIG. 1, an image forming apparatus, such as a laser printer, is schematically illustrated. Referring to FIG. 1, the image forming apparatus may include an exposing unit 10, a transfer unit 20, a pickup unit 30, a delivery unit 40, a fuser unit 50, and a developing unit 60.

The exposing unit 10 may be installed on an upper side of the developing unit 60 and may be configured to scan laser beams corresponding to print data onto an image carrier 62 provided in the developing unit 60.

The transfer unit 20 may be installed and configured to rotate in contact with the image carrier 62 of the developing unit 60 to transfer a toner image formed on the image carrier 62 to a print medium P.

The pickup unit 30 may be configured to pick up the print medium loaded, for example, in a print medium feed unit (not illustrated) sheet by sheet.

The delivery unit 40 may include a pair of delivery rollers 41 and 42 for delivering the print medium picked up by the pickup unit 30 between the transfer unit 20 and the image carrier 62. Additional delivery rollers may be provided to deliver the print medium P.

The fuser unit 50 may include a press roller 51 and a heating roller 52, configured to fuse the toner image onto the printing medium P by applying heat and pressure to the print medium P passing between the press roller 51 and the heating roller 52.

The developing unit 60 may have a structure that can be easily attached to and detached from the image forming apparatus for convenience in repair and maintenance situations. The developing unit 60 may include a developing unit frame 61, the image carrier 62, a charge roller 63, a feed roller 64, a developing roller 65, a waste toner cleaner 66, and a cleaning roller 67.

The developing unit frame 61 may form the exterior of the developing unit 60. On one side of the developing unit frame 61, a toner storage space S to store the toner may be formed, while on the other side thereof, a waste toner space W to accommodate the waste toner may be formed.

The image carrier 62 may be installed and configured to be exposed to an outside of the developing unit frame 61. An electrostatic latent image may be formed on the image carrier 62 by laser beams scanned from the exposing unit 10.

The charge roller 63 may rotate in a direction opposite that of the image carrier 62 and may charge the surface of the image carrier 62 to a predetermined potential level. The charge roller 63 may include, for example, a shaft (not illustrated) rotatably installed and a rubber layer (not illustrated) surrounding an outer periphery of the shaft member.

The feed roller 64 may feed the toner stored in the toner storage space S to the developing roller 65, which may in turn be configured to feed the toner to the image carrier 62 as it rotates in a direction opposite that of the image carrier 62. Thus, the toner image is formed on the latent image formed on the image carrier 62.

The waste toner cleaner 66, which may be opposite the developing roller 65, may be installed and configured to be in contact with the image carrier 62 for removing the waste toner remaining on the image carrier 62 after the toner image formed on the image carrier 62 is transferred to the print medium P.

The cleaning roller 67 may be installed and configured to be in contact with the charge roller 63 for adsorbing and removing the foreign substances, such as toner, shredded paper, dust, and the like, adhering to the surface of the charge roller 63.

Figure 2:
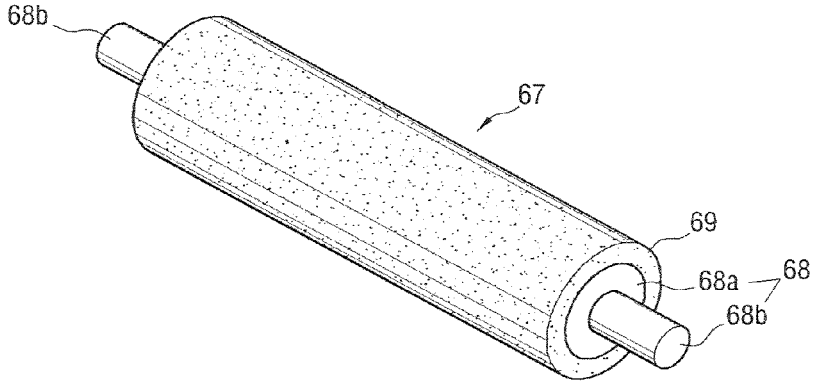
FIG. 2 is a schematic perspective view of a cleaning roller provided in the image forming apparatus of FIG. 1.
Figure 3:
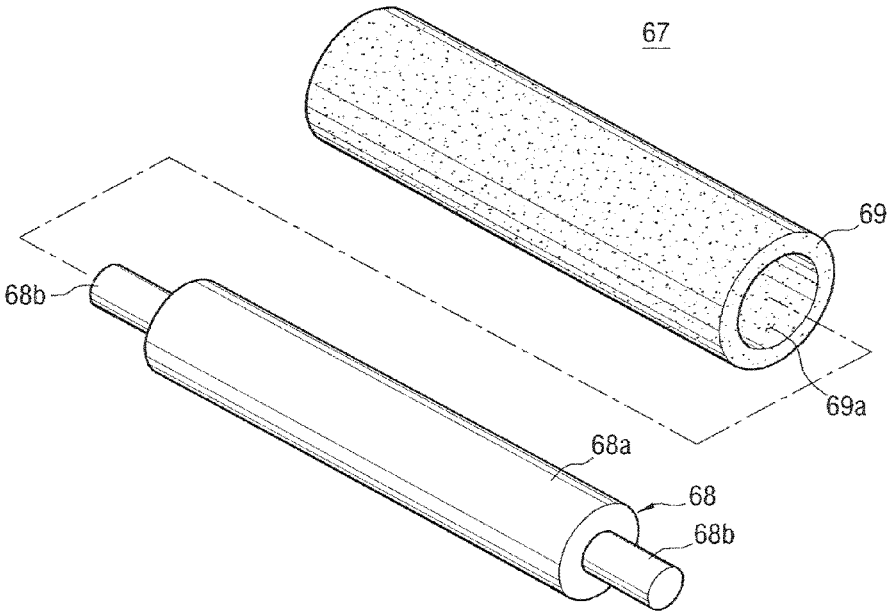
FIG. 3 is an exploded perspective view of the cleaning roller of FIG. 2.

Referring to FIGS. 2 and 3, the cleaning roller 67 may comprise a shaft member 68 and a non-conductive member 69.

The shaft member 68 is provided with a cylindrical rolling part 68*a* and a pair of support parts 68*b* formed to project from both ends of the rolling part 68*a* in a lengthwise direction.

The rolling part 68*a* may be arranged opposite the charge roller 63 as described above, and the outer periphery thereof may be surrounded by the non-conductive member 69. In one embodiment, the rolling part 68*a* has a circular section. However, the rolling part 68*a* may have a hollow circular section in order to reduce material costs, for example. Or the rolling part 68*a* may have, for example, a "H", "I", "T", or "Z"-shaped section to improve the strength. Either of the pair of the support parts 68*b* may be connected to a drive means (not illustrated) to drive the cleaning roller 67.

The shaft member 68 may be manufactured by selectively adding a small amount of a reinforcement material to a main material, which may be, for example, a plastic material. A thermoplastic plastic material or a thermosetting plastic material may be selected as the main material, and glass fiber or polystyrene may be selected as the reinforcement material, for example. If a plastic material is selected as the main material, it may be possible to reduce the material cost and/or weight of the shaft member 68 relatively speaking in comparison to the use of a metallic material.

As described above, by adding a small amount of reinforcement material to the plastic material, the strength of the shaft member 68 may be reinforced. No conductive additive to provide conductivity to the shaft member 68 is added.

Accordingly, the shaft member 68 is non-conductive, e.g., its resistance exceeding $10^9\Omega$ (i.e. the reference resistance value of a non-conductor).

In an embodiment, the support parts 68*b* of the shaft member 68 may be made of a metallic material. In this case, the strength of the support parts 68*b* can be improved, and thus the lifespan of the cleaning roller 67 may be prolonged.

Even in the case where the support parts 68*b* of the shaft member 68 are made of a metallic material, the rolling part 68*a* of the shaft member 68, which is in contact with the non-conductive member 69, is non-conductive, and thus no electricity flows between the shaft member 68 and the non-conductive material 69. Accordingly, the non-conductive shaft member 68 either comprises non-conductive support parts 68*b* and a non-conductive rolling part 68*a* or conductive support parts 68*b* and a non-conductive rolling part 68*a*.

The non-conductive member 69 may have a through hole 69*a* having substantially the same shape as the rolling part 68*a* of the shaft member 68. By inserting the shaft member 68, which may be provided with the rolling part 68*a* having an outer periphery coated with adhesives, into the through hole 69*a*, the shaft member 68 and the non-conductive member 69 may adhere to one another.

The non-conductive member 69 may be formed of polyurethane foam that is manufactured by foam-molding polyurethane, for example. Accordingly, the non-conductive member 69 may have a porous structure with a plurality of apertures formed thereon and elasticity due to the inherent characteristic of the polyurethane. Furthermore, no conductive additive is added to the non-conductive member 69. Accordingly, the non-conductive member 69 is non-conductive in the same manner as the shaft member 68, e.g., its resistance exceeding $10^9\Omega$.

Although polyurethane is selected as the material of the non-conductive member 69 in one embodiment, other non-conductive materials with elasticity may instead be utilized. For example, a rubber material may be selected. The rubber material may be a material which has no conductive additive, such as natural rubber (NR), nitrile butadiene rubber (NBR), ethylene propylene diene M-class (EPDM) rubber, urethane, silicon, poron, or the like. Also, while in one embodiment, the non-conductive member 69 is in the form of a cylinder having a through hole 69*a* formed therein, in another embodiment, the non-conductive member 69 may be provided with a plurality of hairs planted on an outer periphery of the shaft member 68 in a comb shape, for example.

In an embodiment, the cleaning roller 67 is provided to clean the surface of the charge roller 63. However, in another embodiment, the cleaning roller may be provided to clean the surface of another roller provided in the image forming apparatus discussed above with reference to FIG. 1.

Figure 4:
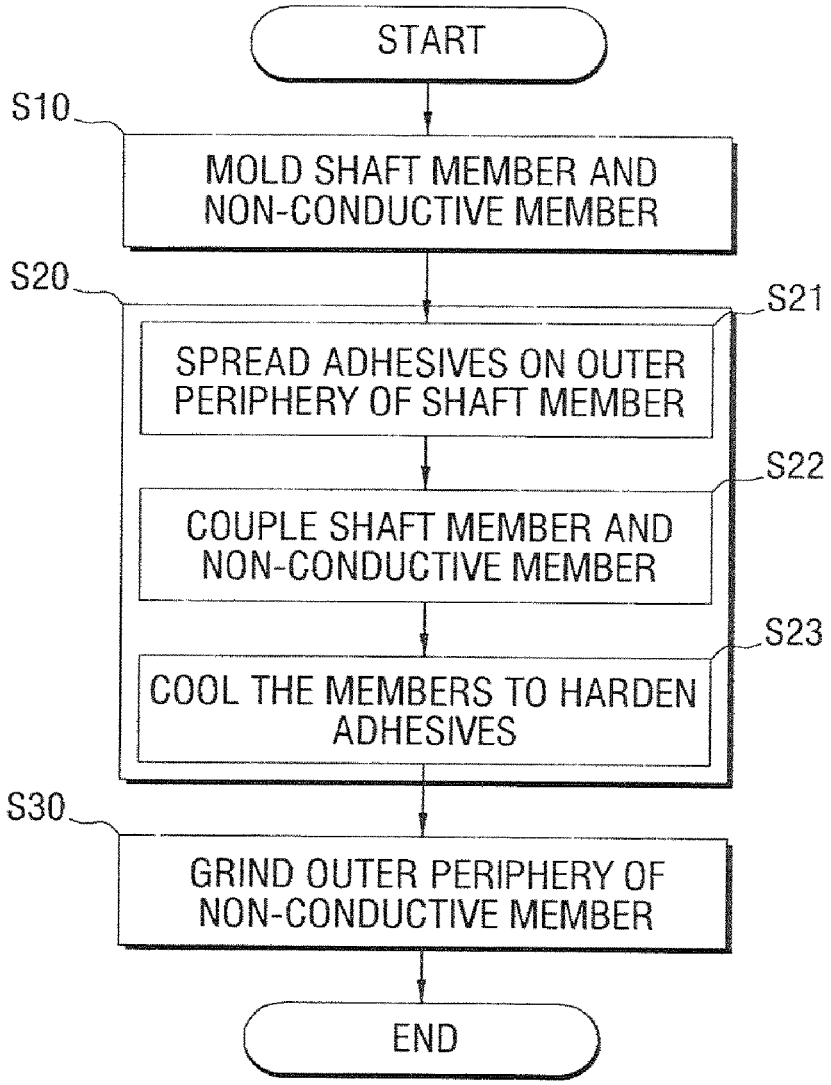
FIG. 4 is a flowchart illustrating a method of manufacturing the cleaning roller of FIG. 2.

The cleaning roller 67 as described above may be manufactured in accordance with the flowchart of FIG. 4 that illustrates an embodiment of a method of manufacturing a cleaning roller 67.

Referring to FIG. 4, the shaft member 68 and the non-conductive member 69 are first molded (operation S10). In an embodiment, the shaft member 68 may be manufactured by injection molding or extrusion molding using a raw material obtained by adding a small amount of a reinforcement material to a plastic material that is the main material. The non-conductive member 69 may be manufactured by foam molding using polyurethane as a raw material, for example.

Figure 5:
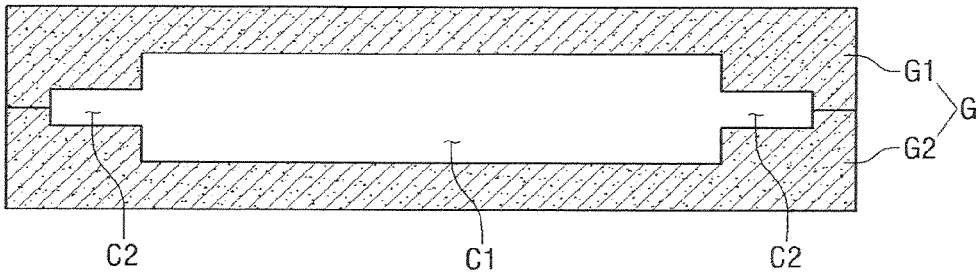
FIG. 5 is a sectional view of a mold for forming a shaft member of the cleaning roller of FIG. 2.

In the case of injection molding the shaft member 68, a mold G composed of an upper mold G1 and a lower mold G2 may be used, as illustrated in FIG. 5. The mold G has inner hollow parts C1 and C2 corresponding to the shape of the shaft member 68.

In another embodiment in which a pair of support parts 68*b* of the shaft member 68 is made of metal, the shaft member 68 may be manufactured in a manner in which the pair of support parts 68*b*, which is formed to be longer than the side hollow part C2 of the mold G, is inserted into the side hollow part C2. Then a plastic material is placed into the center hollow part C1 (insert injection molding).

If the shaft member 68 is molded by injection molding or extrusion molding using the plastic material, the shaft member 68 can be relatively easily molded in comparison to the molding of the shaft member 68 using a metallic material.

Referring again to FIG. 4, the shaft member 68 and the non-conductive member 69 are adhered to one another (operation S20). In operation S20, liquid hot-melt adhesives, for example, are spread along the outer periphery of the rolling part 68*a* of the shaft member 68 (operation S21). Then, the shaft member 68 is inserted into the non-conductive member 69 so that the rolling part 68*a* of the shaft member 68 is arranged in the through hole 69*a* of the non-conductive member 69 (operation S22). Then, the bonded shaft member 68 and non-conductive member 69 are cooled below a predetermined temperature to harden the liquid hot-melt adhesives, or other adhesives, spread on the shaft member 68 (operation S23).

Lastly, the outer periphery of the non-conductive member 69 adhered to the shaft member 68 is grinded or otherwise reduced so that the outer diameter of the cleaning roller 67 reaches a desired numerical value (operation S30).

Operation of the image forming apparatus and the cleaning roller 67 provided in the image forming apparatus according to an embodiment is described with reference to FIG. 1.

If a print command is received in the image forming apparatus according to an embodiment, the charge roller 63 charges the surface of the image carrier 62 to a predetermined potential level, and the exposing unit 10 forms an electrostatic latent image on the surface of the image carrier 62 by scanning laser beams corresponding to print data onto the image carrier 62. Toner stored in the toner storage space S is fed to the developing roller 65 by the feed roller 64. As the image carrier 62 and the developing roller 65 rotate, the toner on the surface of the developing roller 65 is delivered to the surface of the image carrier 62, and the electrostatic latent image formed on the surface of the image carrier 62 is thus developed into a toner image.

When a print command is received in the image forming apparatus, the pickup unit 30 picks up and delivers the print medium P, sheet by sheet, from the print medium feed unit (not illustrated) to the delivery unit 40. The delivery unit 40 directs and delivers the print medium P between the image carrier 62 and the transfer unit 20.

When the print medium P is placed between the image carrier 62 and the transfer unit 20, the toner image formed on the rotating image carrier 62 is transferred to the print medium P. After the toner image is transferred to the print medium P, the waste toner remaining on the surface of the image carrier 62 is removed by the waste toner cleaner 66 and is accommodated in the waste toner space W formed by the developing unit frame 61. The print medium P, to which the toner image has been transferred, is delivered to the fuser unit 50, which fuses the toner image onto the print medium P by applying pressure and heat to the print medium P. Then, the print medium P is discharged from the image forming apparatus to complete the printing operation.

While the printing operation is performed, the cleaning roller 67 provided in the image forming apparatus adsorbs and removes foreign substances, such as toner, shredded paper, dust, and the like, adhering to the surface of the charge roller 63 as it rotates in contact with the charge roller 63. Friction between the rubber layer (not illustrated) on the surface of the charge roller 63 and the non-conductive member 69 of the cleaning roller 67 causes a frictional electrical force (or frictional charging force) to be generated on the non-conductive member 69 of the cleaning roller 67. Due to the frictional electrical force, foreign substances adhering to the charge roller 63 may be adsorbed and removed through the non-conductive member 69 of the cleaning roller 67.

As described above, the cleaning roller 67 according to an embodiment may be composed of a shaft member 68 of a plastic material and a non-conductive member 69 of a polyurethane material, for example, and thus is non-conductive. Due to the cleaning roller 67's non-conductivity, the frictional electrical force generated in the non-conductive member 69 is larger than that of a conductive cleaning roller, and thus the cleaning performance of the cleaning roller 67 due to the friction may be improved.

As the cleaning roller 67 and the charge roller 63 rotate in contact with one another, the non-conductive member 69 of the cleaning roller 67 or the rubber layer of the charge roller 63 may be worn out. In particular, the abrasion of the rubber layer of the charge roller 63 may cause a fatal defect in a printed image. As described above, according to an embodiment, the shaft member 68 of the cleaning roller 67 may be made of a plastic material, rather than a metallic material, and the pressure acting between the non-conductive member 69 of the cleaning roller 67 and the charge roller 63 may accordingly be relieved in comparison to a metallic shaft member. Accordingly, the abrasion of the non-conductive member 69 of the cleaning roller 67 and the rubber layer of the charge roller 63 may be mitigated.

Furthermore, as the shaft member 68 of the cleaning roller 67 is, in an embodiment, made of a plastic material having a relatively low weight, the whole weight of the cleaning roller 67 may be reduced. Accordingly, when an external impact, and particularly an external impact in a direction of gravity, is applied to the developing unit 60 of the image forming apparatus, the force acting on the image carrier 62 by the charge roller 63 may be reduced. In particular, during the external impact, the weight of the cleaning roller 67 may be applied to the image carrier 62 through the charge roller 63. If the cleaning roller 67 has a relatively low weight, it delivers a relatively small force to the image carrier 62 in comparison to other cleaning rollers having a metallic shaft member.

Accordingly, when the external impact is applied to the developing unit 60, the damage of the surface of the image carrier 62 may be reduced. Also, the amount of instantaneous deformation of the image carrier 62 is relatively reduced, and thus the amount of deformation of a frame 61*a* adjacent to the image carrier 62 to form the waste toner space W may be reduced. Accordingly, the possibility of leakage of the waste toner from the waste toner space W due to the external impact may also be reduced.

In various embodiments, a cleaning roller 67 to clean a charge roller 63 is as described. However, the technical features applied to the cleaning roller 67 may be applied to other rollers provided in the image forming apparatus in the same manner. For example, according to an embodiment, a charge roller, a developing roller, a feed roller, or a transfer roller may be formed to have a construction that includes a non-conductive shaft member and a non-conductive member surrounding the shaft member in the same manner as the cleaning roller 67.

Generally, the charge roller, for example, may be formed in a manner in which a center shaft member is surrounded by a non-conductive member, such as, for example, as a foam sponge, and at least a part of the outer periphery of the non-conductive member is surrounded by dense conductive rubber (e.g. natural rubber (NR), nitrile butadiene rubber (NBR), ethylene propylene diene M-class (EPDM) rubber, urethane, silicon, poron, and the like), which includes a conductive additive (e.g. filler, carbon black, and the like). In the construction of the charge roller as described above, the features of the described embodiments may be applied to the shaft member and the non-conductive member except for the conductive rubber.

In the embodiments, a laser printer was described as an example of an image forming apparatus. However, it is apparent that the technical features may be applied to other image forming apparatuses, such as a copy machine, a facsimile, and the like.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A roller for use in a developing unit of an image forming apparatus, the roller comprising:

a non-conductive shaft member comprising:

a non-conductive rolling part comprising a plastic material; and a pair of separate support parts each disposed on opposing ends of the rolling part and comprising a metallic material; and a non-conductive member disposed around the outer periphery of the rolling part.

2. The roller of claim 1, wherein the shaft member has a cross-section of a shape selected from a group consisting of a circular, hollow circular, "H", "I", "T" and "Z" shapes.

3. The roller of claim 2, wherein the shaft member is formed by the use of molding technique selected from a group consisting of injection molding and extrusion molding.

4. The roller of claim 1, wherein the shaft member comprises a reinforcement material selected from a group consisting of glass fiber and polystyrene.

5. The roller of claim 1, wherein the non-conductive member comprises an elastic material having a porous structure.

6. The roller of claim 5, wherein the non-conductive member comprises at least one of polyurethane foam, natural rubber (NR), nitrile butadiene rubber (NBR), ethylene propylene diene M-class (EPDM) rubber, urethane, silicon, and poron.

7. The roller of claim 1, wherein the roller is configured to remove foreign substances on a surface of a charge roller configured to charge an image carrier of the image forming apparatus.

8. The roller of claim 1, wherein the non-conductive member comprises a plurality of hairs planted on an outer periphery of the shaft member.

9. The roller of claim 1, wherein the resistance of the shaft member and the non-conductive member exceeds approximately $10^9\Omega$.

10. A developing unit of an image forming apparatus, comprising:

an image carrier;

a movable charge member configured to charge a surface of the image carrier;

movable cleaning member configured to remove foreign substances on a surface of the charge roller;

a movable developing member configured to deliver a developer to the surface of the image carrier; and a movable supply member configured to supply the developer to the developing roller;

wherein at least one of the members included in the developing unit comprises:

a non-conductive shaft member comprising:

a non-conductive rolling part comprising a plastic material; and a pair of separate support parts each disposed on opposing ends of the rolling part and comprising a metallic material; and a non-conductive member disposed around the outer periphery of the rolling part.

11. The developing unit of claim 10, wherein the non-conductive member comprises an elastic material having a porous structure.

12. The developing unit of claim 11, wherein the non-conductive member comprises at least one of polyurethane foam, natural rubber (NR), nitrile butadiene rubber (NBR), ethylene propylene diene M-class (EPDM) rubber, urethane, silicon, and poron.

13. A method of manufacturing a roller, comprising:

forming a non-conductive shaft member comprising:

a non-conductive rolling part comprising a plastic material; and a pair of separate support parts each disposed on opposing ends of the rolling part and comprising a metallic material;

adhering a non-conductive member to the rolling part; and processing the outer periphery of the non-conductive member to desired measurements.

14. The method of claim 13, wherein:

the forming of the non-conductive shaft member comprises injection molding or extrusion molding a plastic material and a reinforcement material; and the non-conductive member comprises a foamed plastic material.

15. The method of claim 13, wherein the adhering of the non-conductive member to the shaft member comprises:

applying an adhesive to the outer periphery of the rolling part;

inserting the shaft member with the applied adhesive into a through hole of the non-conductive member to bond the shaft member and the non-conductive member; and cooling the bonded shaft member and the non-conductive member to a predetermined temperature.

16. The method of claim 13, wherein the processing of the outer periphery of the non-conductive member comprises grinding the outer periphery to a predetermined outer diameter.

* * * * *